US012320543B2

(12) United States Patent
Nord et al.

(10) Patent No.: US 12,320,543 B2
(45) **Date of Patent: *Jun. 3, 2025**

(54) THERMALLY BROKEN PANEL ASSEMBLY FOR AN AIR HANDLER CABINET

(71) Applicant: Daikin Applied Americas Inc., Minneapolis, MN (US)

(72) Inventors: Spencer Nord, Maple Grove, MN (US); Brent Johnski, Minnetrista, MN (US); Jeremy Small, Plymouth, MN (US)

(73) Assignee: DAIKIN APPLIED AMERICAS INC., Minneapolis, MN (US)

( * ) Notice: Subject to any disclaimer, the term of this patent is extended or adjusted under 35 U.S.C. 154(b) by 173 days.

This patent is subject to a terminal disclaimer.

(21) Appl. No.: 18/304,558

(22) Filed: Apr. 21, 2023

(65) Prior Publication Data

US 2023/0258366 A1 Aug. 17, 2023

Related U.S. Application Data

(63) Continuation of application No. 17/329,825, filed on May 25, 2021, now Pat. No. 11,668,491.

(51) Int. Cl.
*F24F 13/20* (2006.01)
*F24F 13/22* (2006.01)

(52) U.S. Cl.
CPC ..... *F24F 13/20* (2013.01); *F24F 13/22* (2013.01); *F24F 2013/221* (2013.01)

(58) Field of Classification Search
CPC ..... F24F 13/20; F24F 13/22; F24F 2013/221; E04H 17/1456; E04H 1/1238
See application file for complete search history.

(56) References Cited

U.S. PATENT DOCUMENTS 6,497,256 B1 12/2002 Adams et al.
7,678,434 B2 3/2010 Phillips
(Continued)

FOREIGN PATENT DOCUMENTS

CA 2194303 A1 7/1998
CN 111256355 A 6/2020
(Continued)

OTHER PUBLICATIONS

Written Opinion for the corresponding international application No. PCT/US2022/030639, dated Sep. 16, 2022.
International Search Report for the corresponding international application No. PCT/US2022/030639, dated Sep. 16, 2022.
(Continued)

*Primary Examiner* — Emmanuel E Duke
(74) *Attorney, Agent, or Firm* — Global IP Counselors, LLP

(57) ABSTRACT

A thermally broken panel assembly includes a first panel member, a second panel member, a first insulating member, and a second insulating member. The first panel member includes a first base member, and a first wall extending outwardly from an outer edge of the first base member. The second panel member includes a second base member, a second wall extending outwardly from an outer edge of the second base member, and a second flange extending from an upper end of the second wall. The first insulating member is disposed between the first wall and the second flange. The second insulating member is disposed between the first base member and the second base member. A gap is disposed between an edge of the first wall of the first panel member and an edge of the second wall of the second panel member.

15 Claims, 13 Drawing Sheets

(56) References Cited

U.S. PATENT DOCUMENTS

| | | | | |
|---|---|---|---|---|
| 7,752,822 | B2 | 7/2010 | Minelli | |
| 8,186,119 | B1 * | 5/2012 | Huff | F24F 3/0442 52/506.03 |
| 8,875,462 | B2 | 11/2014 | Brown | |
| 8,943,770 | B2 | 2/2015 | Sanders et al. | |
| 9,687,089 | B2 | 6/2017 | Chikkakalbalu et al. | |
| 2006/0283657 | A1 | 12/2006 | Dubensky et al. | |
| 2007/0151169 | A1 | 7/2007 | Kandasamy | |
| 2007/0261345 | A1 * | 11/2007 | Janka | F24F 13/20 52/404.1 |
| 2016/0215997 | A1 * | 7/2016 | Carlyon | B32B 7/05 |
| 2018/0080678 | A1 * | 3/2018 | Carton | F24F 13/06 |
| 2018/0209137 | A1 * | 7/2018 | Carlyon | E04C 2/292 |
| 2020/0096251 | A1 | 3/2020 | Costanza et al. | |

FOREIGN PATENT DOCUMENTS

| | | | |
|---|---|---|---|
| EP | 1 538 274 | A1 | 6/2005 |
| EP | 2 578 959 | A1 | 4/2013 |
| JP | 2012-13312 | A | 1/2012 |
| JP | 2019-137470 | A | 8/2019 |
| NL | 1016602 | C2 | 5/2002 |
| WO | 99/40374 | A1 | 8/1999 |
| WO | 2012/097908 | A1 | 7/2012 |
| WO | 2015/174254 | A1 | 11/2015 |

OTHER PUBLICATIONS

International Preliminary Report on Patentability including Written Opinion for the corresponding international application No. PCT/US2022/030639, issued on Nov. 21, 2023.

* cited by examiner

THERMALLY BROKEN PANEL ASSEMBLY FOR AN AIR HANDLER CABINET

CROSS-REFERENCE TO RELATED APPLICATION

This application is a continuation of U.S. patent application Ser. No. 17/329,825, filed May 25, 2021. The entire disclosure of U.S. patent application Ser. No. 17/329,825 is hereby incorporated herein by reference.

BACKGROUND

Field of the Invention

The present invention generally relates to a thermally broken panel assembly in which thermal bridging is substantially reduced. More specifically, the present invention relates to an air handler cabinet including a thermally broken panel assembly that substantially reduces thermal bridging.

Background Information

Heating, ventilation and air conditioning (HVAC) equipment is commonly housed in an insulated enclosure, such as a cabinet of an air handler unit. The cabinet directs air through the equipment and provides shelter to the components housed within. Due to the redirection of air and an effect from certain components of the HVAC process, high positive and negative pressure differential sections are created throughout the cabinet. The HVAC equipment can be located in many different climate conditions, so the cabinet needs to be thermally insulated to prevent heat loss or gain between the treated interior air, and the exterior air.

Conventional HVAC cabinets are created using panels comprised of thin sheet metal skins and foam insulation cores. The conventional cabinets including these conventional panels are subject to thermal bridging. Thermal bridging is the movement of heat across an object that is more conductive than the materials around the object. While the center of the conventional panel has a very low thermal transmittance value (because of the foam insulation core), the outer edge of the panel (where the sheet metal wraps the edge of the panel) can carry a larger thermal load from the inside of the cabinet to the outside of the cabinet, which lowers the overall R-value of the cabinet and can even cause condensation buildup on the edges of the panels. The R-value is a measure of thermal resistance, and the greater the insulating effectiveness, the larger the R-value. The outer edge of the conventional panel provides a thermal bridge that provides a low resistance path for heat flow, which lowers the insulating effectiveness of the conventional panel and the cabinet including such panels.

SUMMARY

An object of the present invention is to provide a thermally broken panel assembly in which thermal bridging is substantially reduced.

A further object of the present invention is to a provide a structural enclosure, such as an air handler cabinet, that withstands high pressure differentials while maintaining a low thermal transmittance rate.

In view of the state of the known technology, a thermally broken panel assembly in accordance with a first aspect of the present invention includes a first panel member, a second panel member, a first insulating member, and a second insulating member. The first panel member includes a first base member, and a first wall extending outwardly from an outer edge of the first base member. The second panel member includes a second base member, a second wall extending outwardly from an outer edge of the second base member, and a second flange extending from an upper end of the second wall. The first insulating member is disposed between the first wall and the second flange. The second insulating member is disposed between the first base member and the second base member. A gap is disposed between an edge of the first wall of the first panel member and an edge of the second wall of the second panel member.

A thermally broken panel assembly in accordance with a second aspect is the thermally broken panel assembly of the first aspect, in which the first wall extends from an entirety of at least one outer edge of the first base member.

A thermally broken panel assembly in accordance with a third aspect is the thermally broken panel assembly of the first or second aspect, in which a width of the first insulating member is at least as large as a width of the first wall of the first panel member.

A thermally broken panel assembly in accordance with a fourth aspect is the thermally broken panel assembly of any of the first to third aspects, in which a cavity is defined by the first base member of the first panel member, the first insulating member, the second flange of the second panel member, the second wall of the second panel member and the second base member of the second panel member, and in which the second insulating member is disposed in the cavity.

A thermally broken panel assembly in accordance with a fifth aspect is the thermally broken panel assembly of any of the first to fourth aspects, in which the first insulating member extends further outwardly than the second insulating member in a width direction of the thermally broken panel assembly.

In view of the state of the known technology, an HVAC unit in accordance with a sixth aspect of the present invention includes a plurality of frame members defining a frame structure, and a plurality of thermally broken panel assemblies connected to the plurality of frame members to define a cabinet. Each of the plurality of thermally broken panel assemblies includes a first panel member, a second panel member, a first insulating member, a second insulating member, a first gap, and a second gap. The first panel member includes a first base member, and a first wall extending outwardly from an outer edge of the first base member. The second panel member includes a second base member, a second wall extending outwardly from an outer edge of the second base member, and a second flange extending from an upper end of the second wall. The first insulating member is disposed between the first base member of the first panel member and the second flange of the second panel member. The second insulating member is disposed between the first base member of the first panel member and the second base member of the second panel member. The first gap is disposed between an edge of the first wall of the first panel member and the second wall of the second panel member. The second gap is disposed between the second flange of the second panel member and the first base member of the first panel member.

An HVAC unit in accordance with a seventh aspect is the HVAC unit of the sixth aspect, in which the first and second gaps are both greater than about ¾ of an inch.

An HVAC unit in accordance with an eighth aspect is HVAC unit of the sixth or seventh aspect, in which any one of the plurality of thermal panel assemblies is removable from the plurality of frame members to access the interior of the air handler cabinet.

An HVAC unit in accordance with a ninth aspect is the HVAC unit of any of the sixth to eighth aspects, in which at least one of the plurality of thermally broken panel assemblies is removable from the plurality of frame members to access the interior of the cabinet.

An HVAC unit in accordance with a tenth aspect is the HVAC unit of any of the sixth to ninth aspects, in which each side of the frame structure includes at least one of the plurality of thermally broken panel assemblies.

In view of the state of the known technology, a method of forming a thermally broken panel assembly in accordance with an eleventh aspect of the present invention includes inserting a first insulating member in a corner formed in a first panel member. A second panel member is disposed on the first insulating member. The second panel member is not in contact with the first panel member. A second insulating member is injected in a cavity defined by the first panel member, the first insulating member, and the second panel member.

A method of forming a thermally broken panel assembly in accordance with a twelfth aspect is the method of forming a thermally broken panel assembly of the eleventh aspect, in which a surface of a first insulating member is disposed on a support.

A method of forming a thermally broken panel assembly in accordance with a thirteenth aspect is the method of forming a thermally broken panel assembly of the eleventh or twelfth aspect, in which the first insulating member covers a plurality of fastener holes in the first panel member to substantially prevent leakage of the injected second insulating member through the plurality of fastener holes.

A method of forming a thermally broken panel assembly in accordance with a fourteenth aspect is the method of forming a thermally broken panel assembly of any of the eleventh to thirteenth aspects, in which the second panel member is disposed on the first insulating member such that the second panel member is at least one inch removed from the first panel member at all points.

A method of forming a thermally broken panel assembly in accordance with a fifteenth aspect is the method of forming a thermally broken panel assembly of any of the eleventh to fourteenth aspects, in which the first insulating member is at least half the height of the first panel member.

These and other objects, features, aspects and advantages of the present invention will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EXEMPLARY EMBODIMENT(S)

Figure 1:
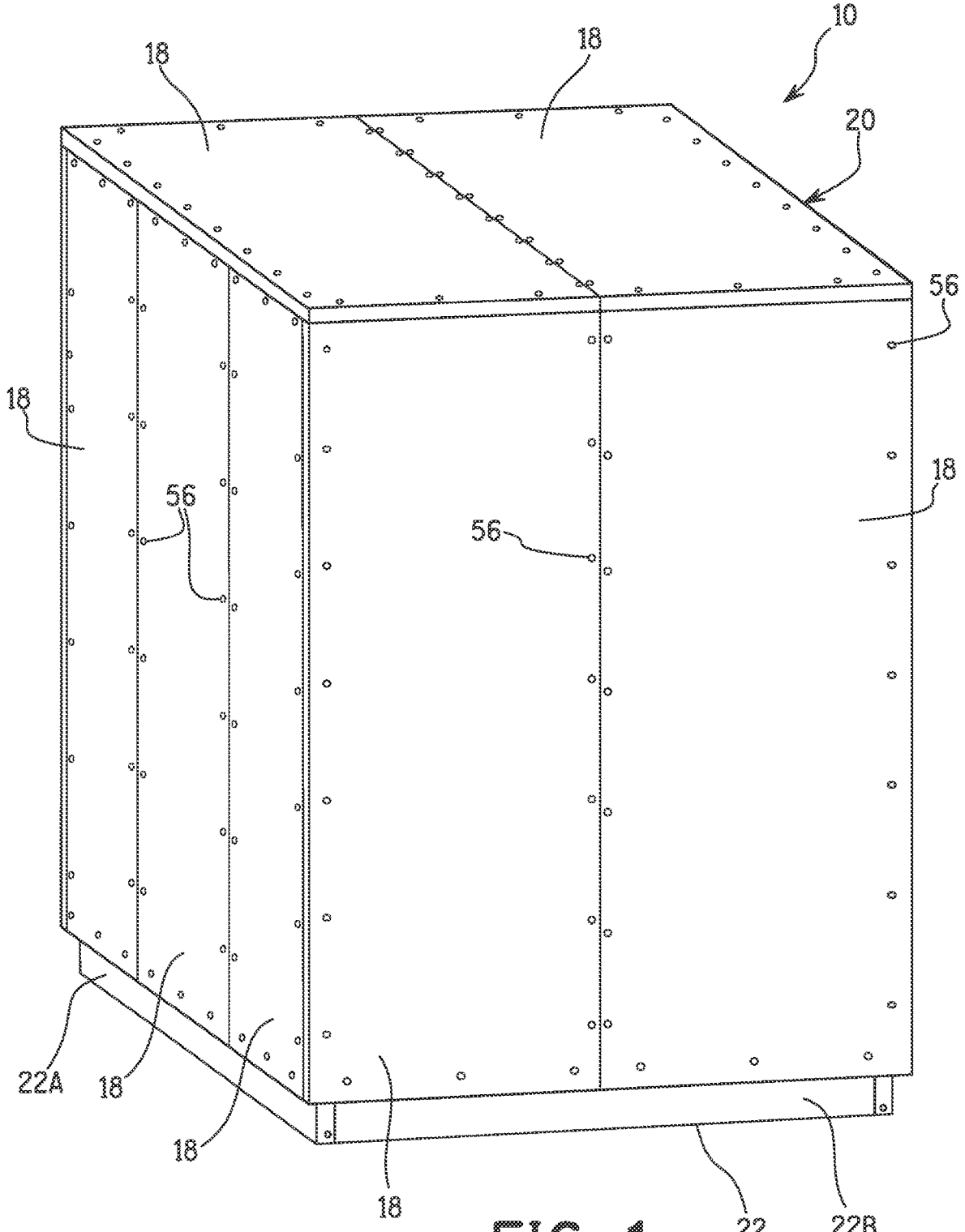
FIG. 1 is a perspective view of an air handler unit in accordance with an exemplary embodiment of the present invention.

Selected embodiments will now be explained with reference to the drawings. It will be apparent to those skilled in the art from this disclosure that the following descriptions of the embodiments are provided for illustration only and not for the purpose of limiting the invention as defined by the appended claims and their equivalents.

Referring initially to FIGS. 1-8, an air handler unit 10 includes a plurality of frame members 12 and 14 that define a frame structure 16 and a plurality of thermally broken panel assemblies 18 removably connected to the plurality of frame members 12 and 14 to define an air handler cabinet 20.

Figure 2:
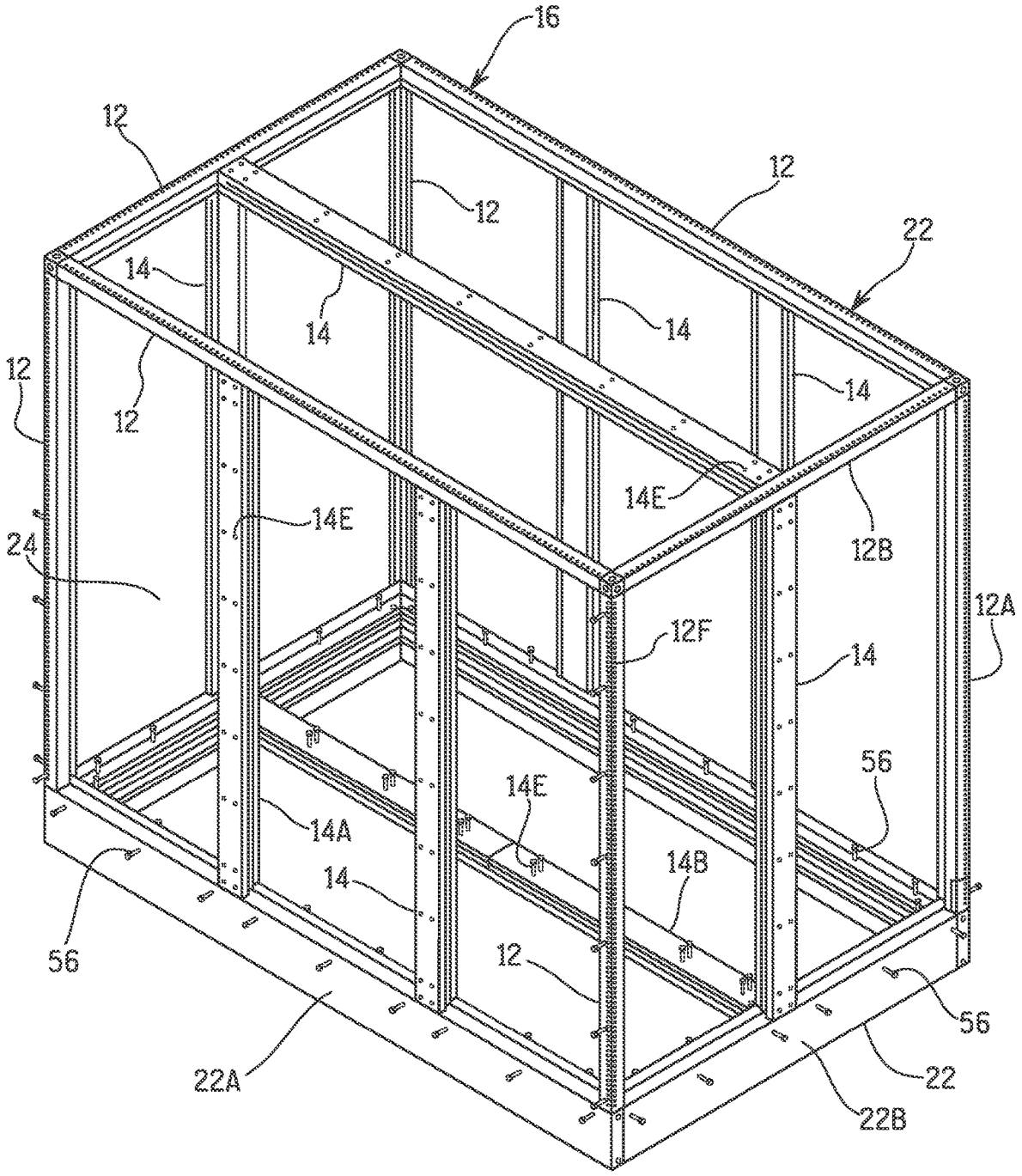
FIG. 2 is a perspective view of a frame structure of the air handler unit of FIG. 1.

As shown in FIGS. 1 and 2, a base 22 of the frame structure 16 supports the air handler cabinet 20 on the ground. The plurality of frame members includes a plurality of first frame members 12 and a plurality of second frame members 14. The first frame members 12 allow two thermally broken panel assemblies 18 to be connected substantially perpendicularly to one another, such as at a corner of the cabinet 20. The second frame members 14 allow two thermally broken panel assemblies 18 to be connected substantially parallel to one another, such as side-by-side on a same side of the cabinet 20.

Figure 3:
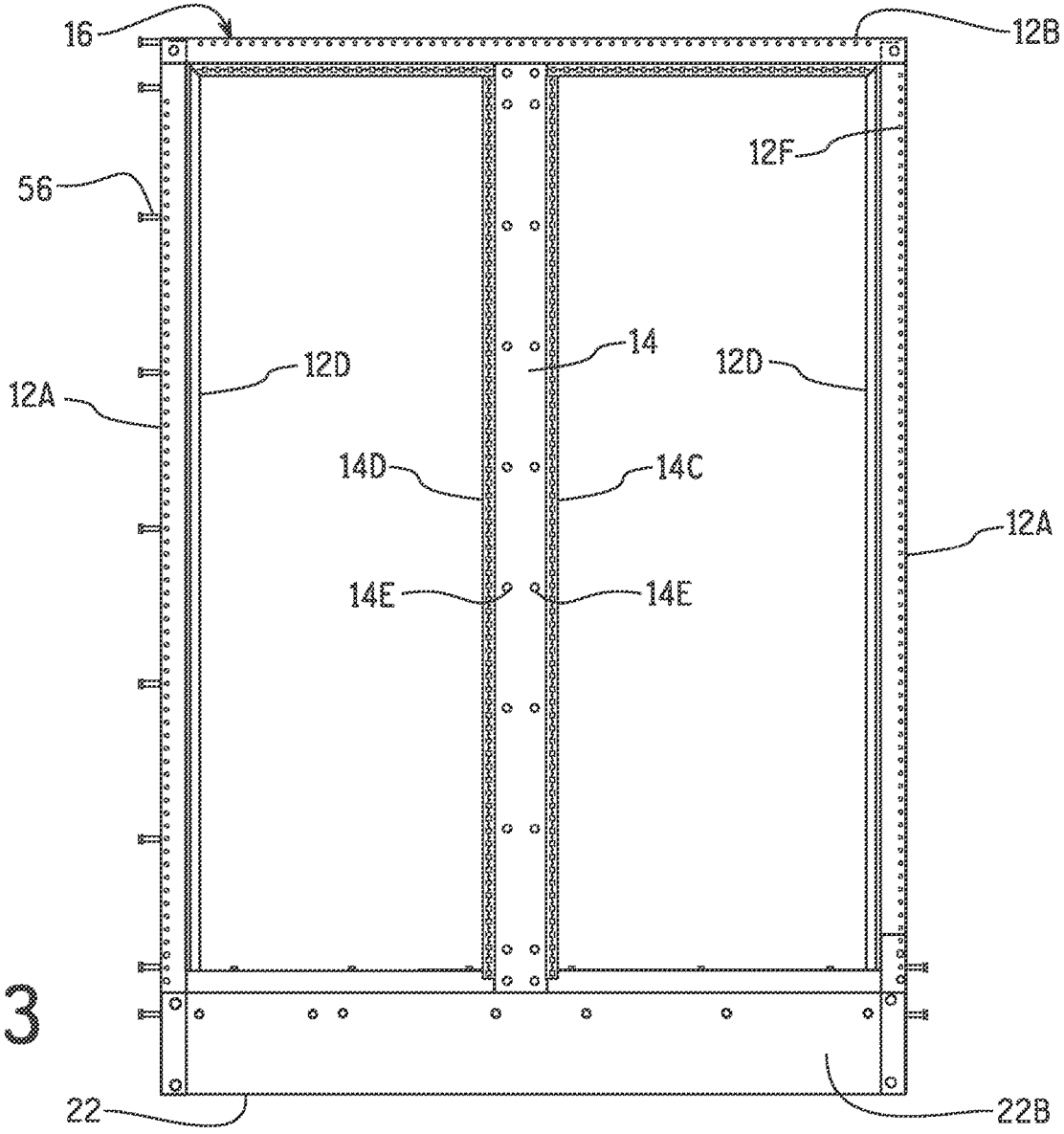
FIG. 3 is a front elevational view of the frame structure of FIG. 2.
Figure 4:
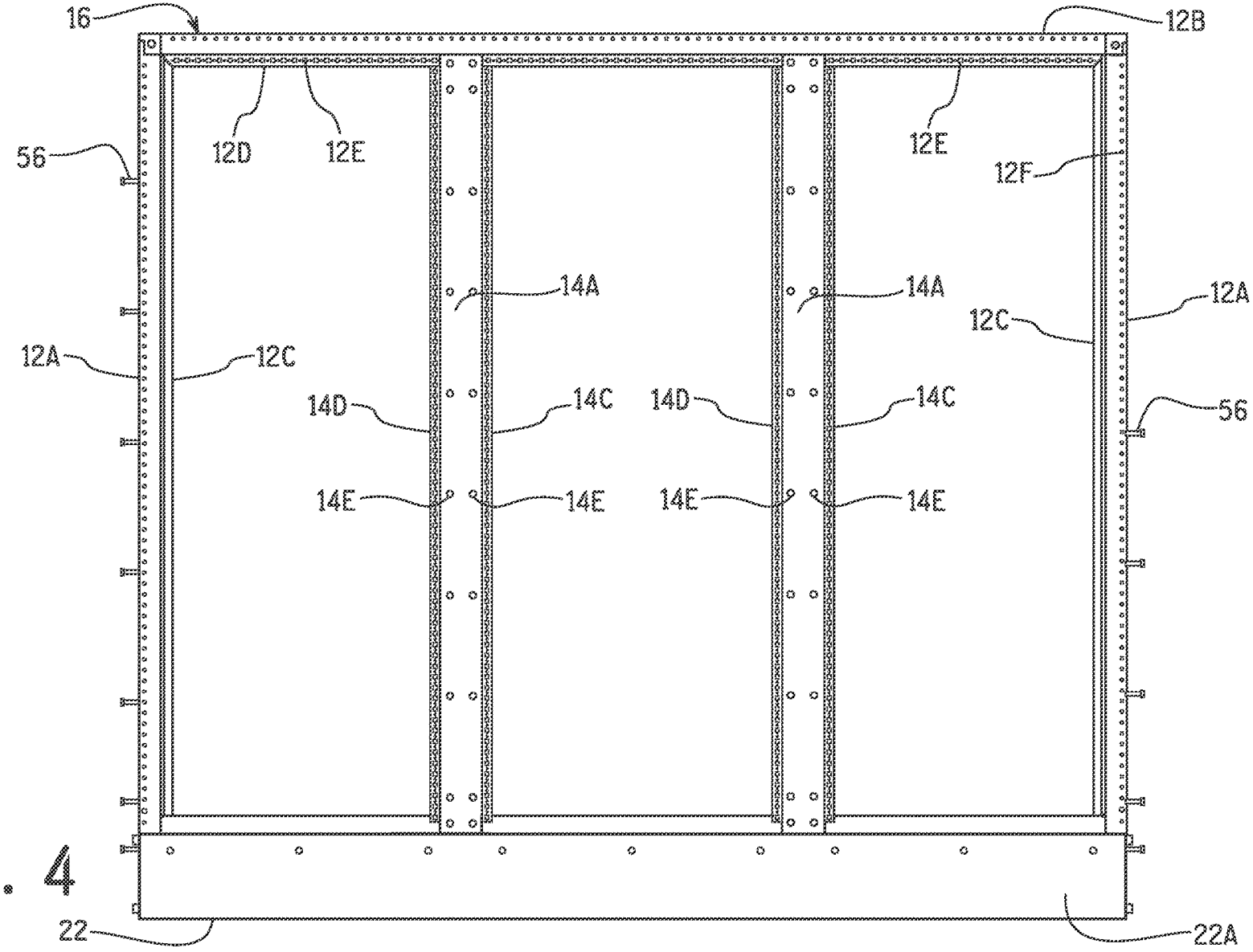
FIG. 4 is a side elevational view of the frame structure of FIG. 2.
Figure 20:
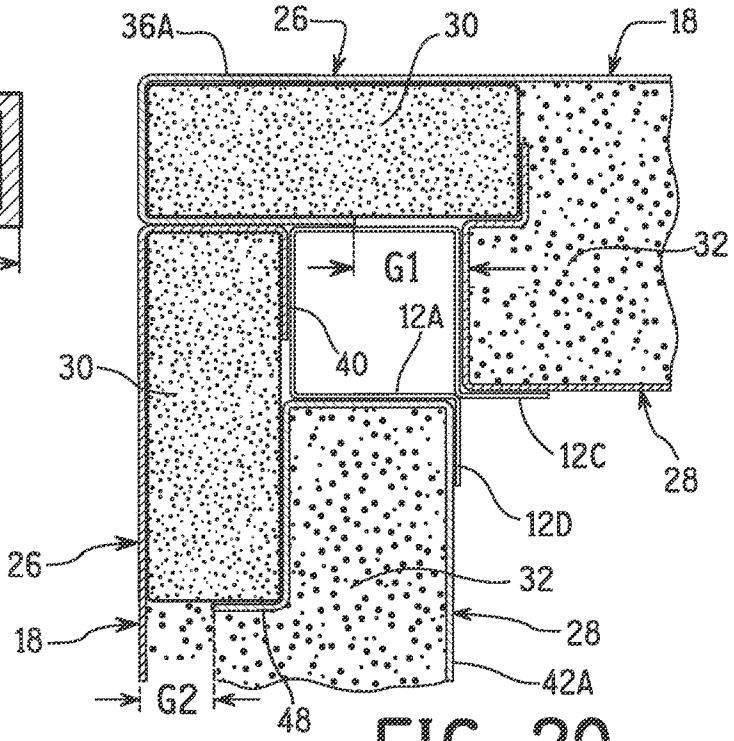
FIG. 20 is a partial top plan view in cross section of two perpendicularly disposed thermally broken panel assemblies of the air handler unit of FIG. 1.
Figure 18:
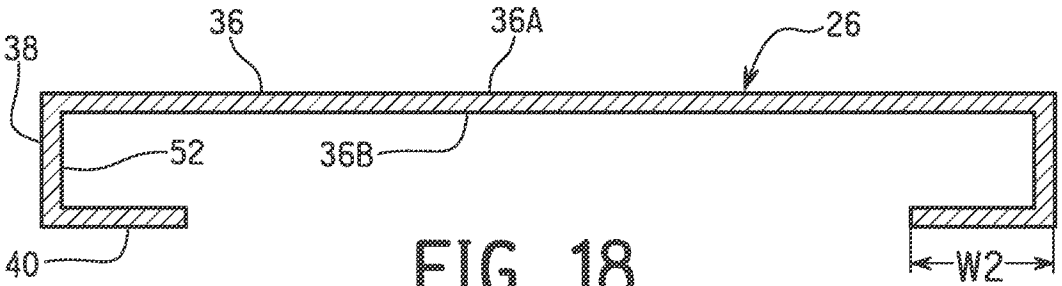
FIG. 18 is an elevational view in cross section of the first panel member of FIG. 16.

The plurality of first frame members 12 include vertical first frame members 12A and horizontal first frame members 12B, as shown in FIG. 2. The vertical first frame members 12A extend vertically from each corner of the base 22. The lower ends of the vertical frame members 12A are connected to the base 22 in any suitable manner, such as with fasteners 56. The horizontal first frame members 12B extend horizontally between upper ends of adjacent vertical first frame members 12A. The horizontal first frame members 12B are connected to the vertical first frame members 12A in any suitable manner, such as with fasteners 56. Each of the first frame members 12 has first and second flanges 12C and 12D, as shown in FIG. 20. The first and second flanges 12C and 12D include a plurality of fastener openings 12E to facilitate connecting the second frame members 14, as shown in FIGS. 1 and 4. The first and second flanges 12C and 12D are substantially perpendicular to one another such that the thermally broken panel assemblies 18 connected thereto are disposed perpendicularly to one another, such as between two adjacent sides of the cabinet, as shown in FIGS. 1 and 20. The first and second flanges 12C and 12D further support the installed panel assemblies 18, as shown in FIG. 20. A gasket (not shown) can be disposed on the first and second flanges 12C and 12D to provide an air seal. The first frame members 12 include a plurality of fastener holes 12F, as shown in FIGS. 2-5, to facilitate connecting the thermally broken panel assemblies 18 thereto. The plurality of fastener openings 12E preferably do not extend entirely through the first frame members 12.

Figure 21:
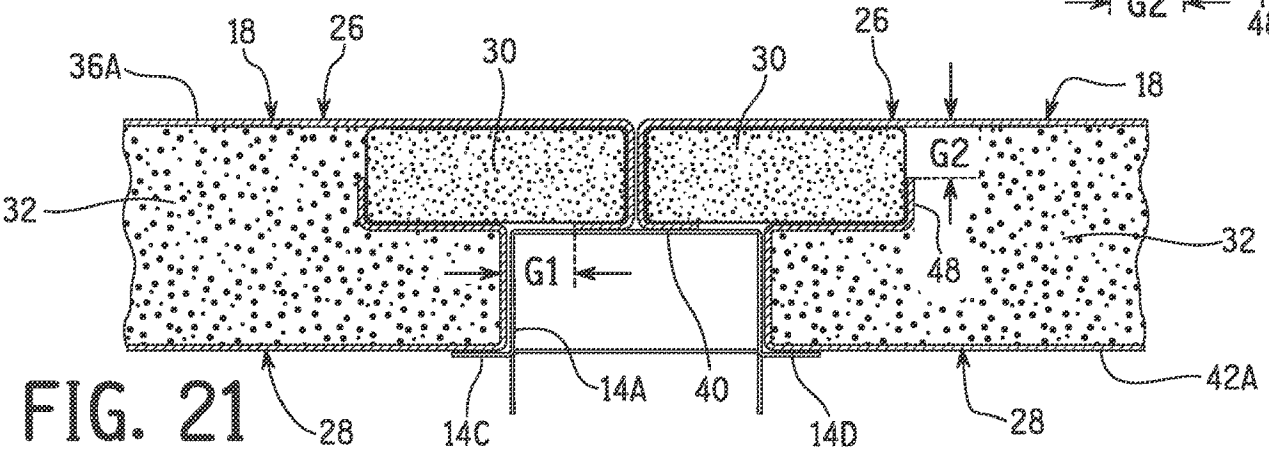
FIG. 21 is a partial top plan view in cross section of two parallel thermally broken panel assemblies of the air handler unit of FIG. 1.

The second frame members 14 include vertical second frame members 14A and horizontal second frame members 14B, as shown in FIG. 1. The vertical second frame members 14A extend vertically between the base 22 and the horizontal first frame members 12B, as shown in FIGS. 2, 3 and 4. The vertical second frame members 14A extend vertically from the base 22. The lower ends of the vertical second frame members 14A are connected to the base 22 in any suitable manner, such as with fasteners 56. The upper ends of the vertical second frame members 14A are connected to the horizontal first frame members 12B, such as to the flange 12D as shown in FIG. 4. The horizontal second frame members 12B extend horizontally. A lower horizontal second frame member 14B extends between opposite sides of the base 22. An upper horizontal second frame member 14B extends between oppositely disposed horizontal first frame members 12B. The horizontal second frame members 14B are connected in any suitable manner, such as with fasteners 56. Each of the second frame members 14 has first and second flanges 14C and 14D, as shown in FIGS. 3, 4 and 21. The first and second flanges 12C and 12D support the installed panel assemblies 18, as shown in FIG. 21. A gasket (not shown) can be disposed on the first and second flanges 14C and 14D to provide an air seal. The second frame members 14 include a plurality of fastener holes 14E to facilitate connecting the thermally broken panel assemblies 18 thereto. The plurality of fastener holes 14E preferably do not extend entirely through the second frame members 14. The first and second flanges 14A and 14B are substantially parallel to one another such that the thermally broken panel assemblies 18 connected thereto are disposed substantially parallel to one another, such as between two adjacent thermally broken panel assemblies on the same side of the cabinet, as shown in FIG. 1.

Figure 8:
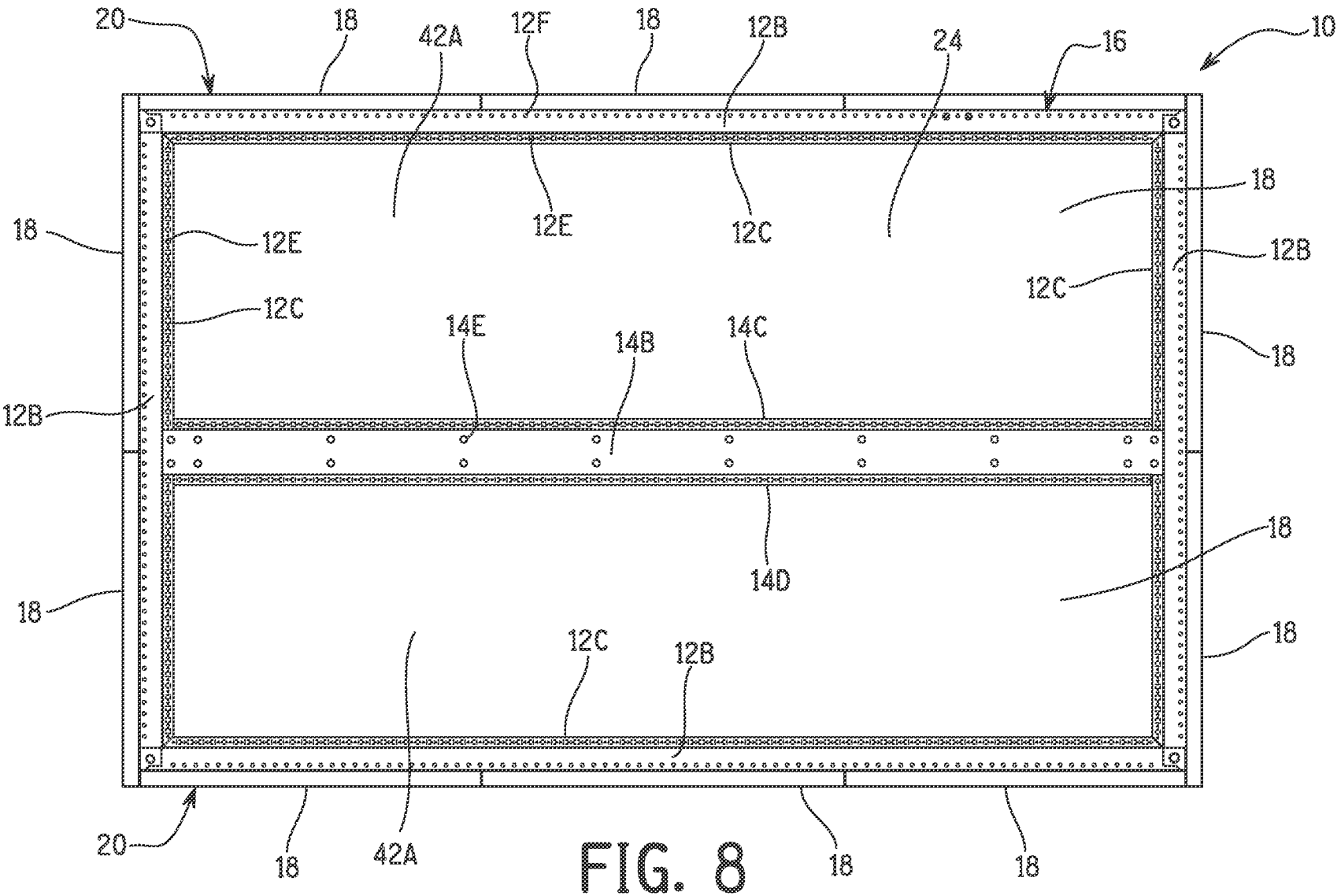
FIG. 8 is a top plan view of the air handler unit of FIG. 1 with upper thermally broken panel assemblies removed.

The thermally broken panel assemblies, or panel assemblies, 18 are connected to the first frame members 12, the second frame members 14 and/or the base 22, as shown in FIG. 1, based on the position of the panel assembly 18. The base 22 is substantially rectangular and has a first side 22A and a second side 22B. The first side 22A is longer than the second side 22B, although the base can have any suitable configuration, such as being substantially square. As shown in the embodiment of FIG. 1, each of the first sides 22A of the base 22 has three panel assemblies 18 connected thereto, and each of the second sides 22B of the base 22 has two panel assemblies 18 connected thereto. The top side of the cabinet 20 has two panel assemblies 18, and the bottom side of the cabinet 20 has two panel assemblies 18, as shown in FIGS. 1 and 8. The embodiment of cabinet 20 illustrated in FIG. 1 has fourteen panel assemblies 18, although the cabinet can have any suitable number of panel assemblies in accordance with the exemplary embodiments of the present invention.

As shown in FIGS. 1 and 3, in some embodiments, each of the second sides 20B of the cabinet 20 has two panel assemblies 18 connected thereto. Each of the two panel assemblies 18 is connected between a vertical second frame member 14A and one of the vertical first frame members 12A. Upper and lower ends of the panel assemblies 18 are connected to one of the horizontal first frame members 12B and the base 22, respectively. The panel assemblies 18 on the second side 20B of the cabinet 20 are substantially parallel to one another.

As shown in FIGS. 1 and 4, in some embodiments, each of the first sides 20A of the cabinet 20 has three panel assemblies 18 connected thereto. The center panel assembly 18 is connected between two second vertical frame members 14A. Each of the two outer panel assemblies 18 is connected between one of the second vertical frame members 14A and one of the first vertical frame members 12A. Upper and lower ends of the panel assemblies 18 are connected to one of the horizontal first frame members 12B and the base 22, respectively. The panel assemblies 18 on the first side of the cabinet 20 are substantially parallel to one another.

Figure 5:
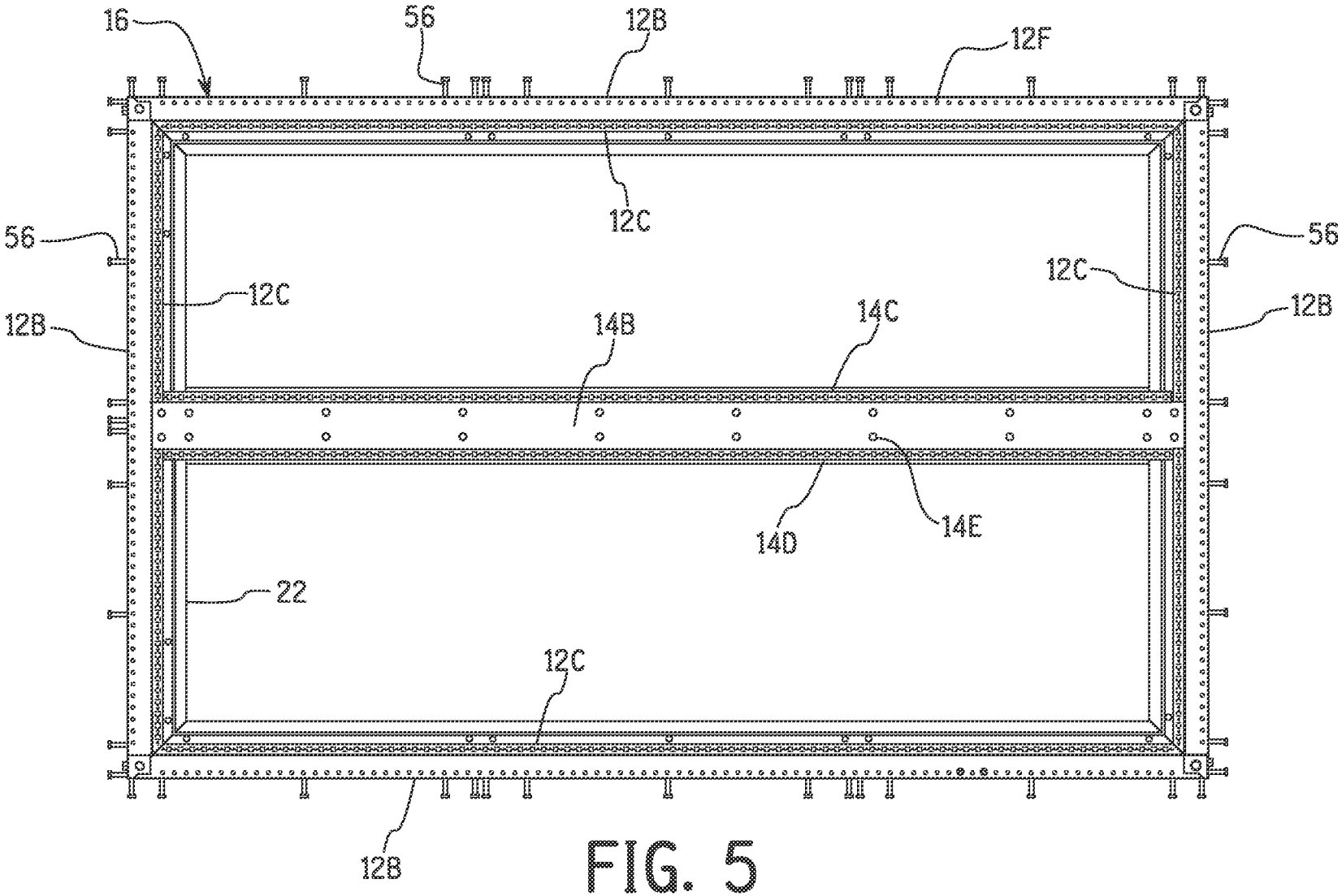
FIG. 5 is a top plan view of the frame structure of FIG. 2.
Figure 6:
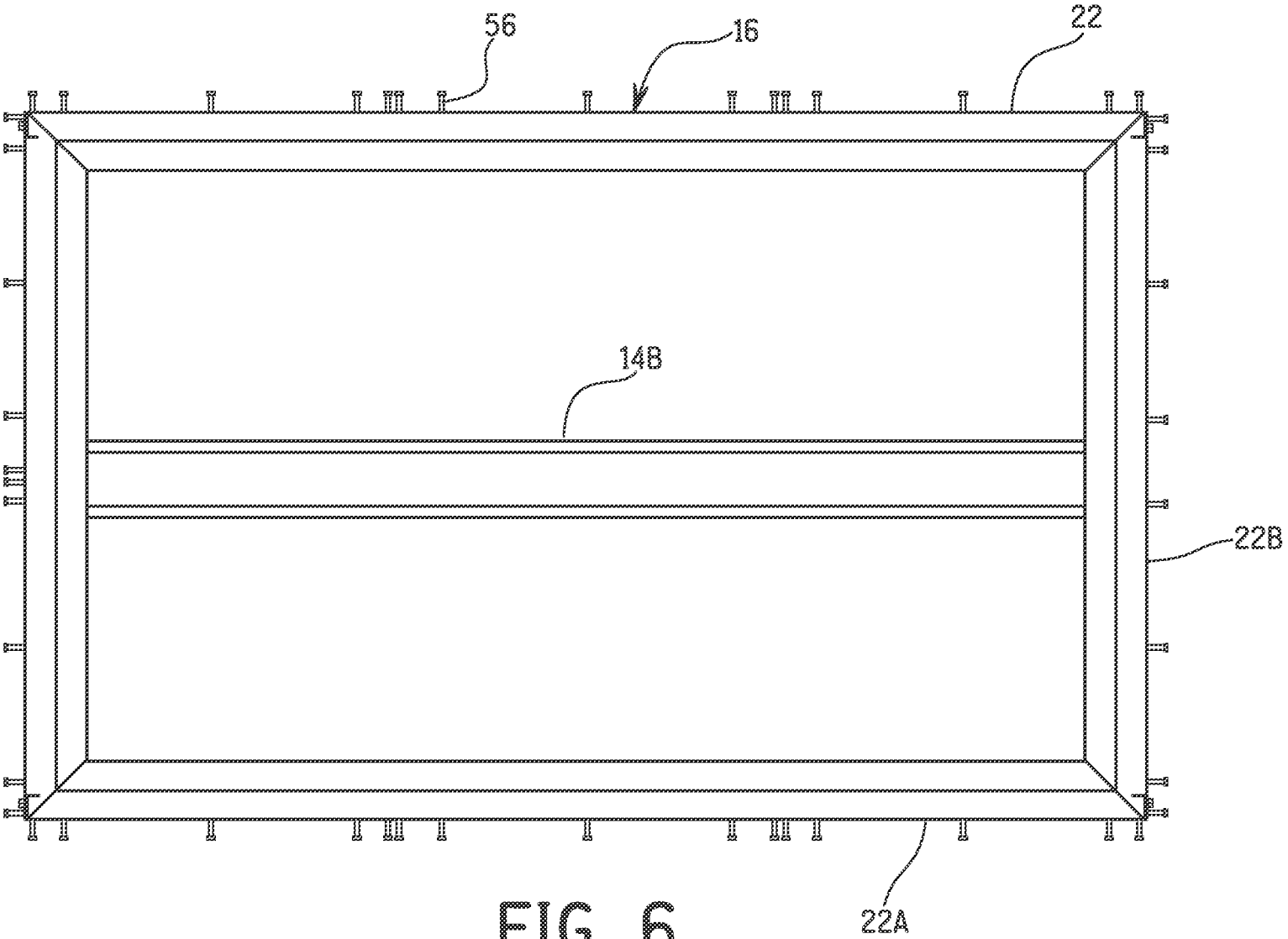
FIG. 6 is a bottom plan view of the frame structure of FIG. 2.
Figures 11, 12, 13, 14:
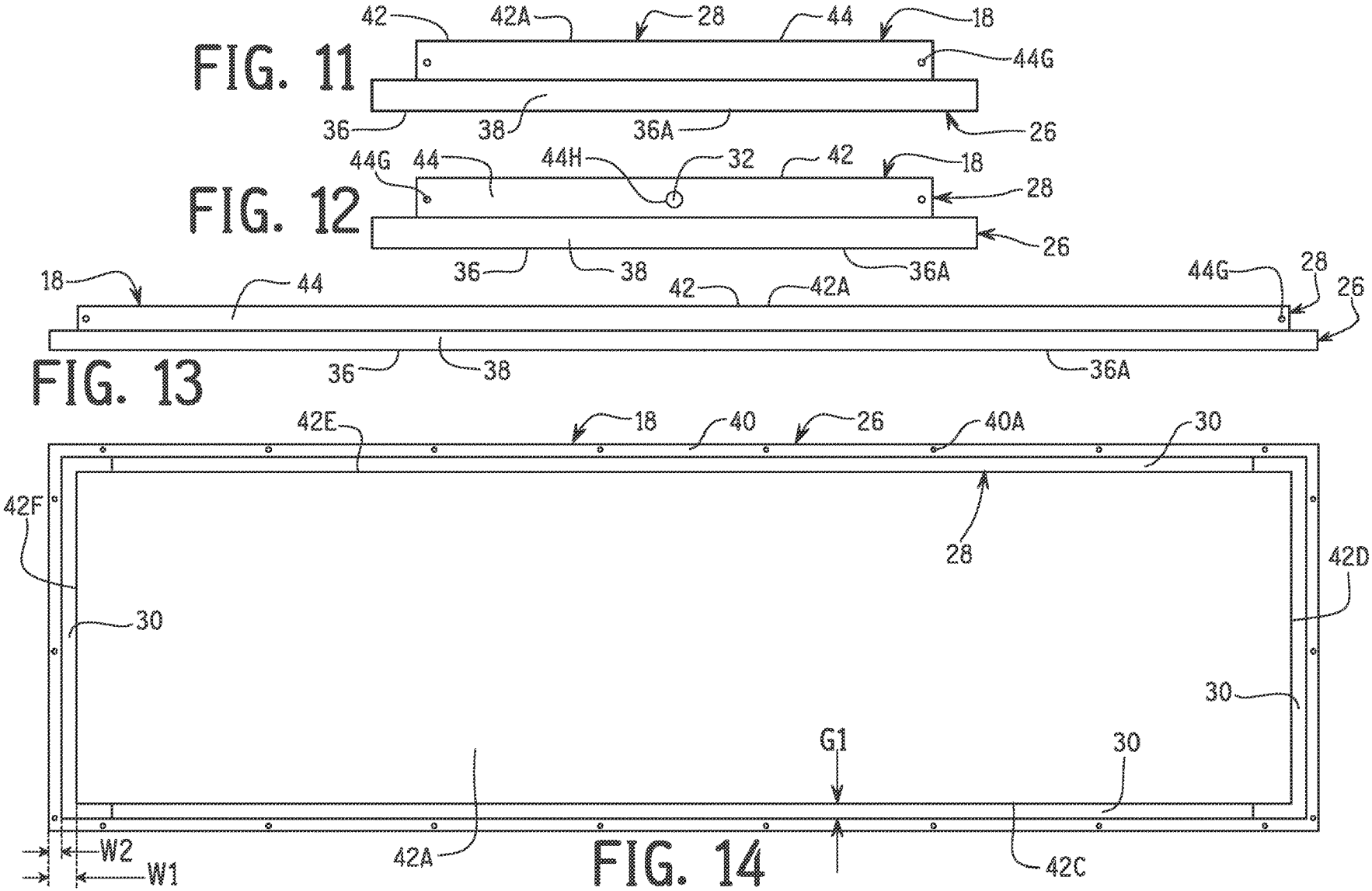
FIG. 11 is a first end elevational view of the thermally broken panel assembly of FIG. 9.
FIG. 12 is a second end elevational view of the thermally broken panel assembly of FIG. 9.
FIG. 13 is a side elevational view of the thermally broken panel assembly of FIG. 9.
FIG. 14 is a plan view of the inner surface of the thermally broken panel assembly of FIG. 9.

As shown in FIGS. 1 and 5, in some embodiments, the top side of the cabinet 20 has two panel assemblies 18. Each of the sides of the two panel assemblies 18 is connected between a horizontal second frame member 14B and one of the horizontal first frame members 12B. Each of the ends of the panel assemblies 18 is connected to one of the horizontal first frame members 12B. The panel assemblies on the top side of the cabinet 20 are substantially parallel to one another. As shown in FIGS. 1, 2 and 12, the top panel assemblies 18 can be easily removed to provide access to an interior 24 of the cabinet 20. Preferably, any one of the panel assemblies 18 on the top and side of the cabinet 20 can be easily removed to provide access to the interior 24 of the cabinet 20. Any one panel assembly 18 can preferably be removed to access the interior 24 of the cabinet 20 without having to remove an additional panel assembly 18. In some embodiments, the floor panels are mounted to provide a watertight floor, such that the floor panels are not removable to access the interior of the cabinet 20. Alternatively, in some embodiments, the floor panels are removable to access the interior of the cabinet 20.

As shown in FIGS. 1 and 6-8, in some embodiments, the bottom side of the cabinet 20 has two panel assemblies 18. Each of the sides of the two panel assemblies 18 is connected between a horizontal second frame member 14B and opposites sides 22A of the base 22. Each of the ends of the panel assemblies 18 is connected to opposite sides 22B of the base 22. The panel assemblies 18 on the bottom side of the cabinet 20 are substantially parallel to one another.

Figure 7:
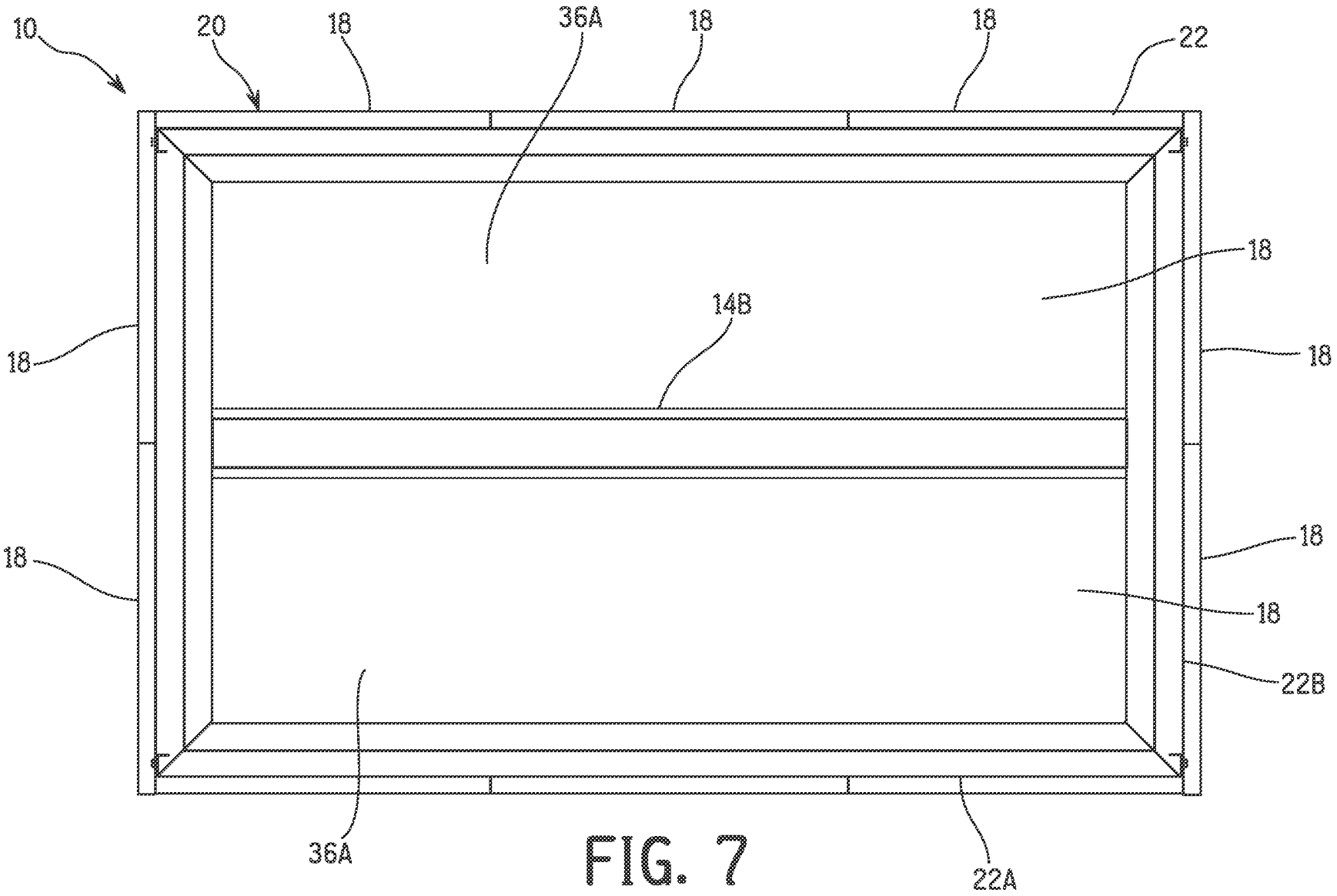
FIG. 7 is a bottom plan view of the air handler unit of FIG. 1.

Each side of the air handler unit 10 preferably includes at least one of the thermally broken panel assemblies 18, as shown in FIGS. 1, 2, 7 and 8. In this exemplary embodiment, the fourteen panel assemblies 18 are connected to the plurality of first and second frame members 12 and 14 and to the base 22 to form the air handler cabinet 20, as shown in FIGS. 1, 7 and 8. The panel assemblies 18 are preferably connected with fasteners 56, as shown in FIGS. 1 and 2, such that the panel assemblies 18 can be easily removed from the plurality of frame members 14 to access the interior 24 of the cabinet 20, as shown in FIG. 8. The panel assemblies 18 preferably substantially define a majority of the exterior of the cabinet 20. An air handler component, such as a heat exchanger and blower, can be disposed in the interior 24 of the cabinet 20. Removably connecting the panel assemblies 18 facilitates accessing the air handler component disposed in the interior 24 of the cabinet 20. Any suitable number of panel assemblies 18 can be used depending on the desired size of the cabinet 20.

Figure 24:
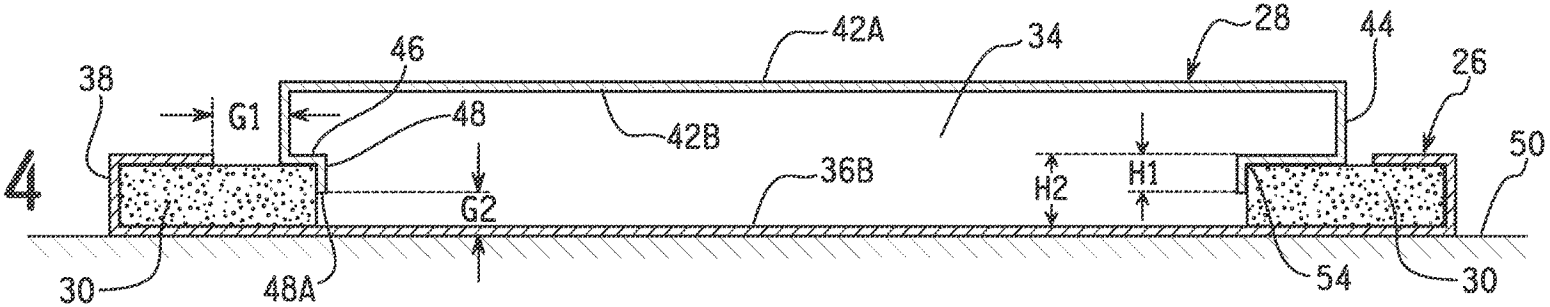
FIG. 24 is an end elevational view in cross section of the second panel member disposed on the first insulating member of FIG. 23.
Figure 25:
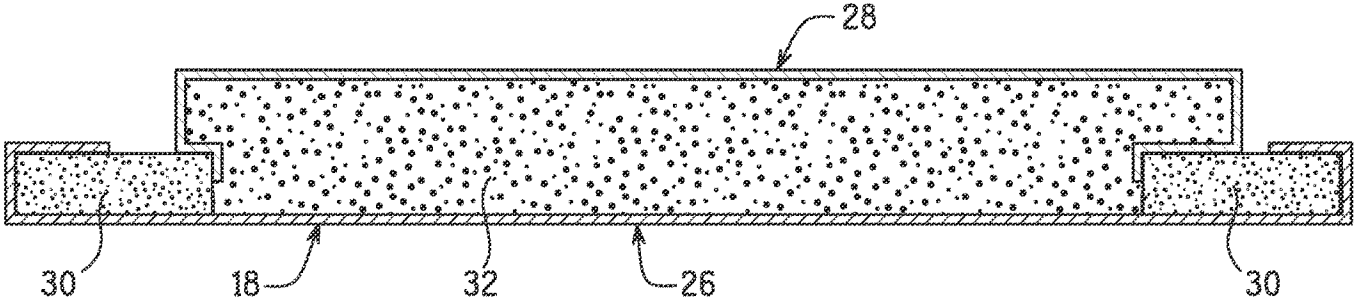
FIG. 25 is an end elevational view in cross section of a second insulating member injected in a cavity defined by the first panel member, the first insulating member and the second panel member of FIG. 24 to form the thermally broken panel assembly of FIG. 9.

As shown in FIGS. 9-15, 20, 21 and 25, the panel assembly 18 includes a first panel member 26, a second panel member 28, a first insulating member 30, and a second insulating member 32. The first insulating member 30 is disposed between the first and second panel member 26 and 28. The first and second panel members 26 and 28 and the first insulating member 30 define a cavity 34 in the panel assembly 18, as shown in FIG. 24. The second insulating member 32 is injected into the panel assembly 18 to substantially fill an entirety of the cavity 34, as shown in FIG. 25.

The first panel member 26 includes a first base member 36, a first wall 38 and a first flange 40, as shown in FIGS. 9, 10, 14 and 15. The first panel member 26 is made of any suitable material, such as steel sheet metal. The sheet metal used to make the first panel member 26 can have any suitable thickness, such as between 26 and 14 gauge sheet metal, inclusive, although thicker or thinner sheet metal can be used. Preferably, the first panel member 26 is unitarily formed from a single piece of sheet metal having a thickness not greater than 14 gauge. As the gauge number increases, the thickness of the sheet metal decreases. In other words, having a thickness not greater than 14 gauge means that the thickness of the sheet metal is less than or equal to the thickness corresponding to 14 gauge, such as 26 gauge.

Figure 10:
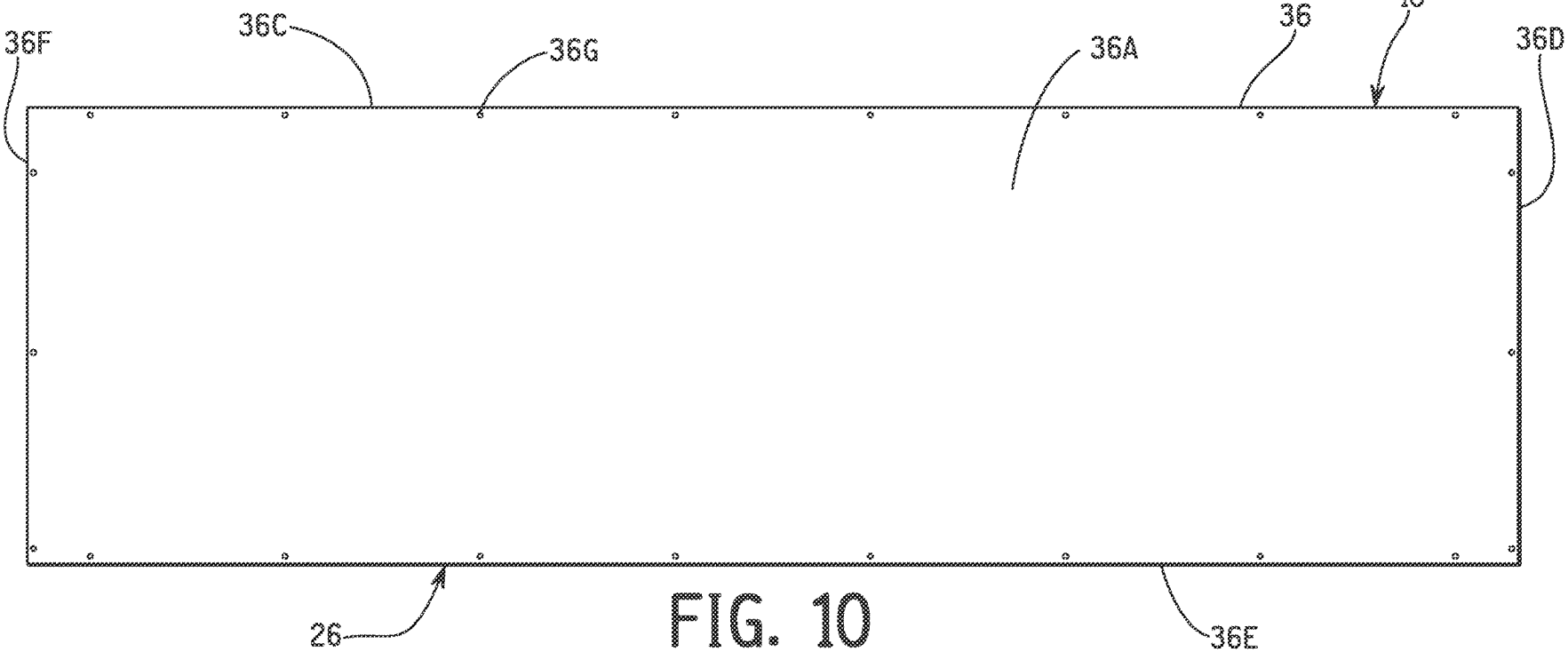
FIG. 10 is a plan view of the outer surface of the thermally broken panel assembly of FIG. 9.
Figure 15:
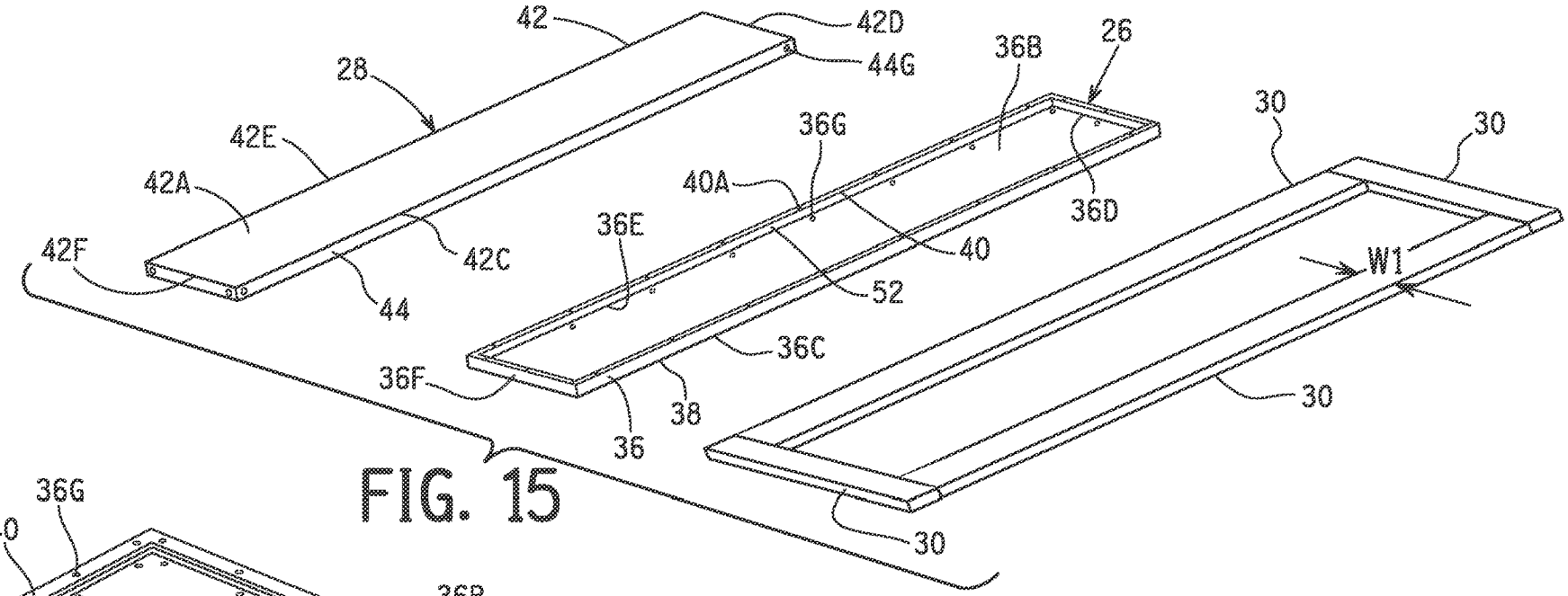
FIG. 15 is an exploded assembly view of the thermally broken panel assembly of FIG. 9.

The first base member 36 has an outer surface 36A and an inner surface 36B, as shown in FIGS. 10 and 15. The first base member 36 is preferably substantially planar. The first base member can have any suitable shape, but is preferably substantially rectangular as shown in FIG. 10. The first base member has first and second oppositely disposed outer edges 36C and 36E, and third and fourth oppositely disposed outer edges 36D and 36F. The third and fourth outer edges 36D and 36F are preferably substantially perpendicular to the first and second outer edges 36C and 36E. The outer surface 36A of the first base member 36 faces an exterior of the cabinet 20 when the panel assembly 18 is connected to the frame structure 16 to form the cabinet 20. A plurality of fastener holes 36G are disposed in the first base member 36 to facilitate connecting the first base member 36 to the frame structure 16. The plurality of fastener holes 36G extend from the outer surface 36A to the inner surface 36B of the first base member 36.

Figure 9:
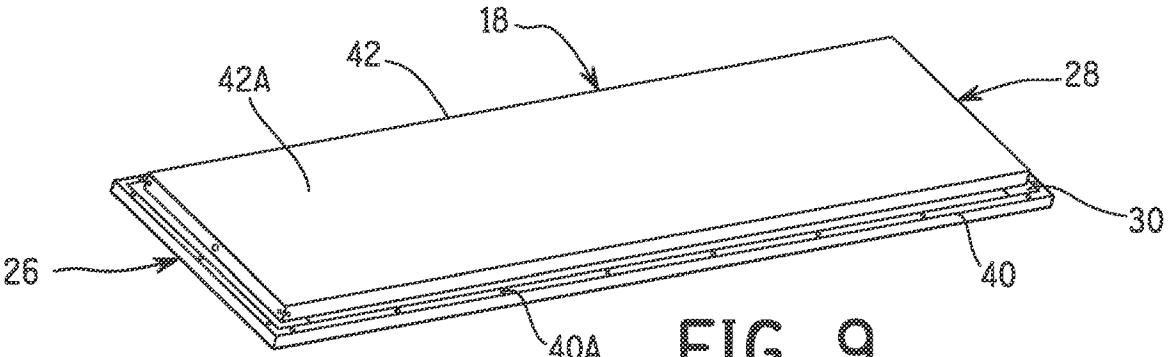
FIG. 9 is a perspective view of a thermally broken panel assembly of FIG. 1.

The first wall 38 extends outwardly from an outer edge 36C of the first base member 36, as shown in FIGS. 9 and 15. The first wall 38 preferably extends substantially perpendicularly to the outer edge 36C of the first base member 36. The first wall 38 extends from an entirety of at least one outer edge 36C of the first base member 36. Preferably, the first wall 38 extends from an entirety of each of the outer edges 36C, 36D, 36E and 36F, as shown in FIG. 15.

The first flange 40 extends inwardly from an upper end 38A of the first wall 38, as shown in FIGS. 14 and 15. Preferably, the first flange 40 extends from an entirety of the upper end 38A of the first wall 38. A plurality of fastener holes 40A are disposed in the first flange 40 of the first panel member 26 to facilitate connecting the first flange 40 to the frame structure 16. The fastener holes 40A extend from an outer surface to an inner surface of the first flange 40. An inner edge 40B of the first flange 40 is spaced inwardly from the first wall 38 of the first panel member 26.

Figure 16:
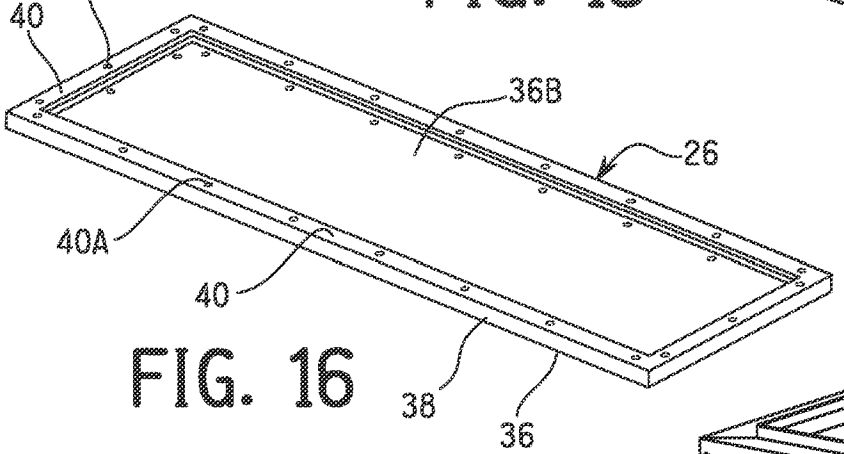
FIG. 16 is a perspective view of a first panel member of the thermally broken panel assembly of FIG. 9.

A channel 52 is defined in the first panel member 26 by the inner surface 36B of the base member 36, the first wall 38, and the first flange 40 of the first panel member 26, as shown in FIGS. 15, 16, 18 and 22. The channel 52 preferably extends around an entirety of the inner perimeter of the first panel member 26, as shown in FIG. 16.

The second panel member 28 includes a second base member 42, a second wall 44, a second flange 46, and a third wall 48, as shown in FIGS. 9, 15, 17, 19 and 24. The second panel member 28 is made of any suitable material, such as steel sheet metal. The sheet metal used to make the second panel member 28 can have any suitable thickness, such as between 26 and 14 gauge sheet metal, inclusive, although thicker or thinner sheet metal can be used. Preferably, the second panel member 28 is unitarily formed from a single piece of sheet metal having a thickness not greater than 14 gauge. As the gauge number increases, the thickness of the sheet metal decreases. In other words, having a thickness not greater than 14 gauge means that the thickness of the sheet metal is less than or equal to the thickness corresponding to 14 gauge, such as 26 gauge.

Figure 17:
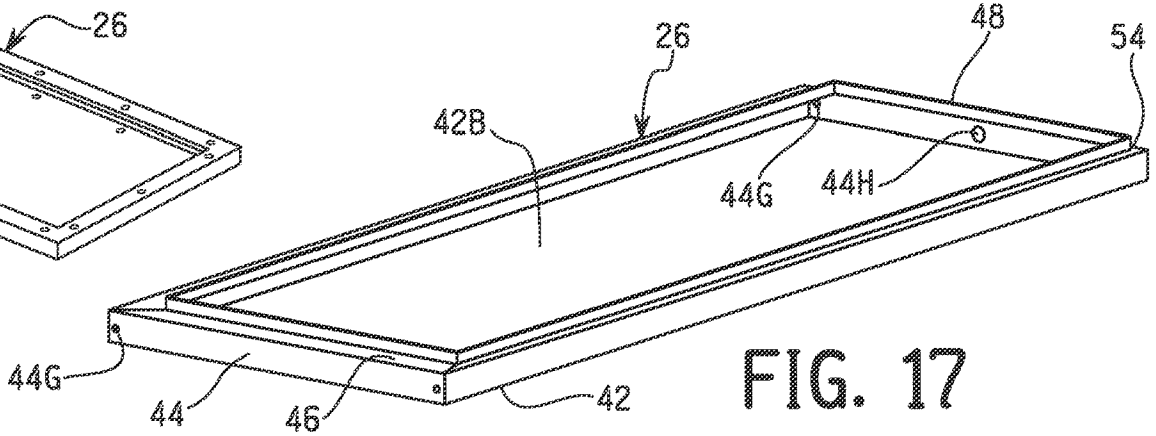
FIG. 17 is a perspective view of a second panel member of the thermally broken panel assembly of FIG. 9.

The second base member 42 has an outer surface 42A and an inner surface 42B, as shown in FIGS. 9 and 17. The second base member 42 is preferably substantially planar. The second base member 42 can have any suitable shape, but is preferably substantially rectangular as shown in FIGS. 9, 14 and 17. The second base member 42 has first and second oppositely disposed outer edges 42C and 42E, and third and fourth oppositely disposed outer edges 42D and 42F. The third and fourth outer edges 42D and 42F are preferably substantially perpendicular to the first and second outer edges 42C and 42E. The outer surface 42A of the second base member 42 faces the interior 24 (FIG. 2) of the cabinet 20 when the panel assembly 18 is connected to the frame structure 16 to form the cabinet 20.

The second wall 44 extends outwardly from an outer edge 42C of the second base member 42, as shown in FIG. 17. The second wall 44 preferably extends substantially perpendicularly to the outer edge 42C of the second base member 42. The second wall 44 extends from an entirety of at least one outer edge 42C of the second base member 44. Preferably, the second wall 44 extends from an entirety of each of the outer edges 42C, 42D, 42E and 42F, as shown in FIGS. 15 and 17. A plurality of vent holes 44G are disposed in the second wall 44 of the second panel member 28 to facilitate venting the panel assembly when the second insulating member 32 is injected, as shown in FIGS. 11-13. An injection opening 44H is disposed in the second wall 44, as shown in FIGS. 12 and 17, to facilitate injection of the second insulating member 32.

The second flange 46 extends inwardly from an upper end 44A of the second wall 44, as shown in FIG. 17. Preferably, the second flange 46 extends from an entirety of the upper end 44A of the second wall 44. The second flange 46 is preferably substantially parallel to the second base member 42. The second flange 46 is preferably substantially perpendicular to the second wall 44.

Figure 19:
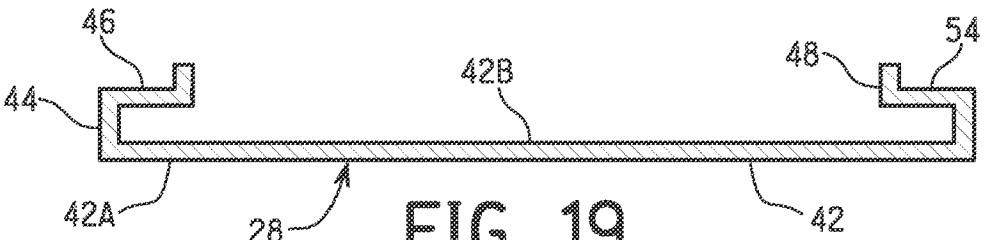
FIG. 19 is an elevational view in cross section of the second panel member of FIG. 17.

A third wall 48 extends outwardly from an inner edge of the second flange 46, as shown in FIG. 17. The third wall 48 is preferably substantially parallel to the second wall 44. The second flange 46 and the third wall 48 of the second panel member 28 define a step 54, as shown in FIGS. 17 and 19.

The first insulating member 30 is disposed between the first panel member 26 and the second panel member 28, as shown in FIGS. 15, 20, 21, 23 and 24. The first insulating member 30 is disposed between the first wall 38 of the first panel member 26 and the third wall 48 of the second panel member 28 in a width direction of the panel assembly 18. The first insulating member 30 is disposed between the first base member 36 of the first panel member 26, the first flange 40 of the first panel member 26, and the second flange 46 of the second panel assembly 28 in a height direction of the panel assembly 18, as shown in FIG. 24. As shown in FIG. 15, the thermally broken panel assembly 18 includes four first insulating members 30. Preferably, each of the first insulating members 30 has the same width W1, although the lengths can be different. Alternatively, the first insulating members 30 can have different widths depending on the location of the panel assembly 18 on the cabinet 20. One first insulating member 30 is shown on each side of the thermal panel assembly in FIG. 15, although any suitable number of first insulating members 30 can be used. The first flange 40 conceals the first insulating member 30 when viewed from the outer surface 36A of the first panel member 26, as shown in FIGS. 1 and 10. The first insulating member 30 can be any suitable insulating material, such as fiberglass.

The second insulating member 32 is disposed between the first panel member 26 and the second panel member 28, as shown in FIG. 25. The second insulating member 32 can be any suitable insulating material, such as polyurethane.

Figure 22:
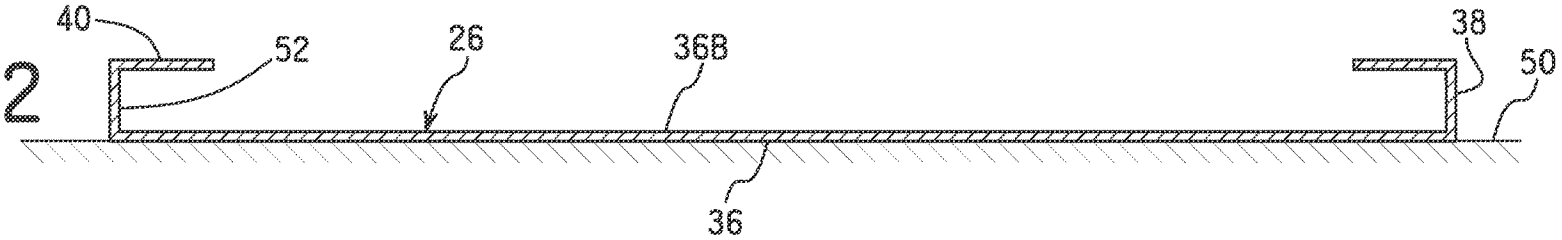
FIG. 22 is an end elevational view in cross section of the first panel member of the thermally broken panel assembly of FIG. 9.

Assembly of the thermally broken panel assembly 18 is shown in FIGS. 22-25. As shown in FIG. 22, the outer surface 36A of the first base member 18 is disposed on a support 50, such as a work table or the ground.

Figure 23:
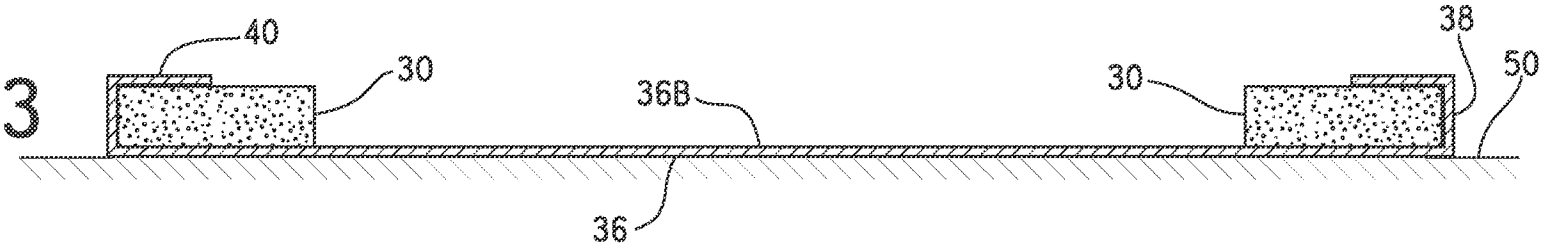
FIG. 23 is an end elevational view in cross section of a first insulating member disposed in the first panel member of FIG. 22.

The first insulating member 30 is disposed in a channel 52 formed in the first panel member 26, as shown in FIG. 23. The channel 52 is defined by the inner surface 36B, the first wall 38 and the first flange 40 of the first panel member 26. The width W1 of the first insulating member 30 is larger than a width W2 of the first flange 40 of the first panel member 26, as shown in FIGS. 14, 15 and 17. As shown in FIG. 15, the first insulating member 30 is disposed in the entirety of the channel 52 formed in the first panel member 26. The first insulating member 30 covers the plurality of fastener holes 36G in the first base member 36 and the plurality of fastener holes 40A in the first flange 40 of the first panel member 26, as shown in FIG. 14, to substantially prevent leakage of the second insulating member 32 through the plurality of fastener holes during injection of the second insulating member 32 (FIG. 25). The first insulating member 30 is inserted in the channel 52 such that an entirety of the inner edge of the first panel member 26 is contacted by the first insulating member 30, as shown in FIGS. 14 and 15, and covers each of the fastener holes 40A on the inner surface 40B of the first flange 40, as shown in FIG. 23. The first insulating member 30 covers each of the fastener holes 36G disposed in the first base member 36 of the first panel member 26, as shown in FIG. 14.

The second panel member 28 is disposed on the first insulating member 26, as shown in FIG. 24. The second panel member 28 is located on the first insulating member 26 by engaging the step 54 of the second panel member 28 with the first insulating member 30. The second panel member 28 does not contact the first panel member 26. The cavity 34 formed when the second panel member 28 is disposed on the first insulating member 30 is defined by the first base member 36 of the first panel member 26, the first insulating member 30, the third wall 48 of the second panel member 28, the second flange 46 of the second panel member 28, the second wall 44 of the second panel member 28, and the second base 42 of the second panel member 28, as shown in FIG. 24. A height H1 of the third wall 48 is less than a height H2 of the first insulating member 30.

A first gap G1 is disposed between an inner edge of the first flange 40 of the first panel member 26 and the second wall 44 of the second panel member 28 in an extension direction of the first flange 40, as shown in FIG. 24. The second panel member 38 is disposed on the first insulating member 30 such that a portion of first insulating member 30 is exposed, as shown in FIGS. 14 and 24.

A second gap G2 is disposed between an upper edge of the third wall 48 of the second panel member 28 and the first base member 36 of the first panel member 26, as shown in FIG. 24. An upper edge 48A of the third wall 48 is spaced from the inner surface 36B of the first base member 36 in an extension direction of the third wall 48.

The first and second gaps G1 and G2 can be any suitable length, and preferably are both greater than about ¾ of an inch. More preferably, the second panel member 28 is preferably disposed on the first insulating member 30 such that the second panel member 28 is at least one inch removed, or spaced, from the first panel member 26 at all points. In other words, no portion of the second panel member 28 is preferably within one inch of any portion of the first panel member 26 when the second panel member 28 is disposed on the first insulating member 30.

The assembled first and second panel assemblies 26 and 28 and the first insulating member 30 are then moved to a conventional press to inject the second insulating member 32. The press maintains the position of the first and second panel assemblies 26 and 28 and the first insulating member 30 during the injection of the second insulating member 32. No adhesive, tape or other fastening means are required to be used to secure the first and second panel members together. The second insulating member 32 is injected in the cavity 34 defined by the first panel member 26, the first insulating member 30, and the second panel member 28, as shown in FIG. 25. The second insulating member 32 is injected through the injection opening 44H (FIG. 17) in the third wall 44 of the second panel member 28. The vent holes 44G (FIGS. 11-15 and 17) facilitate venting of the air within the panel assembly 18 when the second insulating member 32 is injected in the cavity 34. The panel assembly 18 is removed from the press when the second insulating member 32 is cured, which secures the first and second panel assemblies 26 and 28 together. The first insulating member 30 extends further outwardly than the second insulating member 32 in a width direction of the panel assembly 18. The panel assembly 18 can then be connected to the frame structure 16 to form the cabinet 20 of the air handler unit 10.

The gaps G1 and G2, as shown in FIGS. 20, 21 and 24, provide a thermal break in the panel assembly 18. The gaps G1 and G2 disrupt the flow of thermal energy through the panel assembly 18, which increases the thermal resistance of the panel assembly 18 and substantially removes thermal loss points that can cause condensation to form on exterior and interior surfaces of the panel assembly 18. The first insulating member 30 reinforces the edges of the panel assembly 18, which allows the panel assembly 18 to withstand the pressure associated with injection of the second insulating member 32 without requiring framing along the outer edges of the panel assembly 18 during injection of the second insulating member 32. This also allows thinner sheet metal to be used for the first and second panel members 26 and 28 because the configuration of the panel assembly 18 does not require edge support to resist foam pressure associated with injection of the second insulating member 32. The first insulating member 30 covers the fastener holes 36G and 40A (FIG. 16) in the first panel member 26 to prevent leakage during injection and curing of the second insulating member 32. The step 54 in the second panel member 28 (FIG. 24) facilitates locating the second panel assembly 28 with the first panel member 26 and the first insulating member 30 without requiring any form of tape, adhesive or locating tool, thereby providing quick and efficient assembly of the panel assembly 18. The step 54 increases the moment of inertia of the panel assembly 18, thereby decreasing the deflection of the first and second panel members 26 and 28 while under high pressure differentials associated with operation of an air handler component disposed in the air handler unit 10 (FIG. 1).

The assembled panel assemblies 18 can then be connected to the first and second frame members 12 and 14 of the frame structure 16 to assemble the cabinet 20. The panel assemblies 18 can be assembled in a shop, and then transported to a site at which the cabinet 20 is to be constructed. The first and second panel members 26 and 28 are automated bender ready, such that the first and second panel members 26 and 28 can be quickly and efficiently manufactured with minimal human labor. Once the panel assemblies 18 are connected to the frame structure 16, a panel assembly 18 can be easily removed to access the interior of the cabinet 20. In some embodiments, the floor panels 18 are mounted to provide a watertight seal, such that the floor panels are not removable to access the interior of the cabinet 20. Alternatively, in some embodiments, any of the panels 18 is removable to access the interior of the cabinet 20.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts.

The term "detect" as used herein to describe an operation or function carried out by a component, a section, a device or the like includes a component, a section, a device or the like that does not require physical detection, but rather includes determining, measuring, modeling, predicting or computing or the like to carry out the operation or function.

The term "configured" as used herein to describe a component, section or part of a device includes hardware and/or software that is constructed and/or programmed to carry out the desired function.

The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. A thermally broken panel assembly comprising:
- a first panel member including
  - a first base member; and
  - a first wall extending outwardly from an outer edge of the first base member;
- a second panel member including
  - a second base member;
  - a second wall extending outwardly from an outer edge of the second base member; and
  - a second flange extending from an upper end of the second wall;
- a first insulating member disposed between the first wall of the first panel member and the second flange of the second panel member;
- a second insulating member disposed between the first base member of the first panel member and the second base member of the second panel member, and
- a gap disposed between an edge of the first wall of the first panel member and an edge of the second wall of the second panel member.

2. The thermally broken panel assembly according to claim 1, wherein
- the first wall extends from an entirety of at least one outer edge of the first base member.

3. The thermally broken panel assembly according to claim 1, wherein
- a width of the first insulating member is at least as large as a width of the first wall of the first panel member.

4. The thermally broken panel assembly according to claim 1, wherein
- a cavity is defined by the first base member of the first panel member, the first insulating member, the second flange of the second panel member, the second wall of the second panel member and the second base member of the second panel member, the second insulating member being disposed in the cavity.

5. The thermally broken panel assembly according to claim 1, wherein the first insulating member extends further outwardly than the second insulating member in a width direction of the thermally broken panel assembly.

6. An HVAC unit comprising:

a plurality of frame members defining a frame structure; and a plurality of thermally broken panel assemblies connected to the plurality of frame members to define a cabinet;

each of the plurality of thermally broken panel assemblies including a first panel member including a first base member; and a first wall extending outwardly from an outer edge of the first base member;

a second panel member including a second base member;

a second wall extending outwardly from an outer edge of the second base member; and a second flange extending from an upper end of the second wall;

a first insulating member disposed between the first base member of the first panel member and the second flange of the second panel member;

a second insulating member disposed between the first base member of the first panel member and the second base member of the second panel member;

a first gap disposed between an edge of the first wall of the first panel member and the second wall of the second panel member; and a second gap disposed between the second flange of the second panel member and the first base member of the first panel member.

7. The HVAC unit according to claim 6, wherein the first and second gaps are both greater than about ¾ of an inch.

8. The HVAC unit according to claim 6, wherein any one of the plurality of thermal panel assemblies is removable from the plurality of frame members to access the interior of the air handler cabinet.

9. The HVAC unit according to claim 6, wherein at least one of the plurality of thermally broken panel assemblies is removable from the plurality of frame members to access the interior of the cabinet.

10. The HVAC unit according to claim 6, wherein each side of the frame structure includes at least one of the plurality of thermally broken panel assemblies.

11. A method of forming a thermally broken panel assembly, comprising the steps of inserting a first insulating member in a corner formed in a first panel member;

disposing a second panel member on the first insulating member, the second panel member not being in contact with the first panel member; and injecting a second insulating member in a cavity defined by the first panel member, the first insulating member, and the second panel member.

12. The method of forming a thermally broken panel assembly according to claim 11, further comprising the step of disposing a surface of a first insulating member on a support.

13. The method of forming a thermally broken panel assembly according to claim 11, wherein the first insulating member covers a plurality of fastener holes in the first panel member to substantially prevent leakage of the injected second insulating member through the plurality of fastener holes.

14. The method of forming a thermally broken panel assembly according to claim 11, wherein the second panel member is disposed on the first insulating member such that the second panel member is at least one inch removed from the first panel member at all points.

15. The method of forming a thermally broken panel assembly according to claim 11, wherein the first insulating member is at least half the height of the first panel member.

* * * * *